US007459866B2

(12) United States Patent
Yu et al.

(10) Patent No.: US 7,459,866 B2
(45) Date of Patent: Dec. 2, 2008

(54) DC TO DC CONVERSION CIRCUIT WITH VARIABLE OUTPUT VOLTAGE

(75) Inventors: Ya-yun Yu, Hsin-Chu (TW); Yueh-bao Lee, Hsin-Chu (TW); Jian-Shen Li, Hsin-Chu (TW)

(73) Assignee: AU Optronics Corp., Hsin-Chu (TW)

( * ) Notice: Subject to any disclaimer, the term of this patent is extended or adjusted under 35 U.S.C. 154(b) by 0 days.

(21) Appl. No.: 11/682,001

(22) Filed: Mar. 5, 2007

(65) Prior Publication Data

US 2008/0018266 A1 Jan. 24, 2008

(30) Foreign Application Priority Data

Jul. 20, 2006 (TW) ..... 95126598 A

(51) Int. Cl.
*H05B 41/36* (2006.01)

(52) U.S. Cl. ..... 315/291

(58) Field of Classification Search ..... 315/291, 315/307, 244–245, 224, 225, 209 R, 300, 315/311, 349; 345/204

See application file for complete search history.

(56) References Cited

U.S. PATENT DOCUMENTS

| | | | | |
|---|---|---|---|---|
| 6,577,512 | B2 * | 6/2003 | Tripathi et al. | 363/21.17 |
| 7,122,971 | B2 * | 10/2006 | Yeh et al. | 315/185 R |
| 7,265,681 | B2 * | 9/2007 | Chen | 340/815.45 |
| 2004/0251854 | A1 * | 12/2004 | Matsuda et al. | 315/291 |
| 2004/0251857 | A1 * | 12/2004 | Ryu et al. | 315/364 |
| 2007/0114951 | A1 * | 5/2007 | Tsen et al. | 315/291 |

* cited by examiner

*Primary Examiner*—Douglas W. Owens
*Assistant Examiner*—Minh Dieu A

(57) ABSTRACT

The present invention provides a DC to DC conversion circuit, comprising a DC power supply, a DC to DC converter, a power management IC and a load, wherein the load may be a backlight source of a liquid crystal display. The power management IC controls the DC to DC converter to convert a DC voltage supplied by the DC power supply to an output voltage of the DC to DC converter, which is supplied to the load. The power management IC is capable of controlling the DC to DC converter to adjust the output voltage to a minimum voltage actually needed by the load according to the variation of the minimum voltage which is actually needed by the load.

19 Claims, 7 Drawing Sheets

DC TO DC CONVERSION CIRCUIT WITH VARIABLE OUTPUT VOLTAGE

FIELD OF THE INVENTION

The present invention relates to a DC to DC conversion circuit with variable output voltage, more particularly, to a DC to DC conversion circuit capable of adjusting its output voltage to a minimum voltage needed by a load.

BACKGROUND OF THE INVENTION

As known, a liquid crystal display (LCD) needs a backlight source for lighting up the frame of the LCD. The backlight source is a device which consumes the most power of the LCD. The power consumption of the LCD can be diminished by reducing the power consumption of the backlight source. A main rule of LCD circuit design is to diminish the power consumption of backlight source.

Referring to FIG. 1, a conventional DC to DC conversion circuit 10 comprises a DC power supply 102, a DC to DC converter 104, a power management IC 106, a load 108, a current feedback device 110 and two resistors R1, R2. The DC to DC converter 104 is capable of transferring a DC voltage provided by the DC power supply 102 to an output voltage Vout in order to supply the voltage needed by the load 108. The load 108 may be a backlight source of LCD. The backlight source can be consisted of a plurality of light emitting diodes (LED). The current feedback device 110 controls a current flowed through the load 108 in order to stabilize the current flowed through the load 108. The output voltage Vout is supplied to two resistors R1, R2 which are connected in series. The two resistors R1, R2 divide the output voltage Vout and provide a feedback voltage Vfb between the resistors R1, R2 to the power management IC 106. The power management IC 106 controls the DC to DC converter 104 to adjust the output voltage Vout in response to the feedback voltage Vfb so that the output voltage can be adjusted to meet the voltage needed by the load 108.

The series resistors R1, R2 are set with fixed resistances to match the voltage needed by the load 108. The output voltage Vout will still be a fixed voltage value when the voltage actually needed by the load 108 decreases. The feedback voltage Vfb divided by the series resistors R1, R2 will not be changed when the voltage actually needed by the load 108 decreases. Accordingly, the power management IC 106 can not control the DC to DC converter 104 to decrease the output voltage Vout. The higher output voltage will not only increase the power consumption of the load 108, but also decrease the durability of the load 108.

Therefore, there is a need to provide a novel DC to DC conversion circuit capable of reporting the variation of the voltage actually needed by the load to the power management IC for controlling the DC to DC converter to generate the voltage actually needed by the load. The novel DC to DC conversion circuit will not only capable of decreasing the power consumption of the load, but also capable of increasing the durability of the load.

SUMMARY OF THE INVENTION

It is an object of the present invention to provide a DC to DC conversion circuit with variable output voltage. The DC to DC conversion circuit is capable of adjusting the output voltage to match the minimum voltage needed by the load for decreasing the power consumption of the load and increasing the durability of the load.

The DC to DC conversion circuit in accordance with the present invention comprises a DC power supply, a DC to DC converter, a power management IC, a load, a controller, a current controlling circuit, and a variable resistance circuit. The load may be a backlight source in an LCD, and the backlight source may be consisted of a plurality of LEDs which are connected in series. The power management IC controls the DC to DC converter for converting a voltage provided by the DC power supply to an output voltage to supply to the load. The current controlling circuit is used to stabilize the current flowed through the load. A remnant voltage of the load will be varied when the voltage needed by the load changes. The controller can adjust the equivalent resistance of the variable resistance circuit in response to the variation of the remnant voltage. A feedback voltage of the variable resistance circuit will be changed in response to the variation of the equivalent resistance of the variable resistance circuit. Therefore, the power management IC can control the DC to DC converter to adjust output voltage thereof for matching the minimum voltage needed by the load.

The DC to DC conversion circuit according to the present invention can also use a voltage controlling circuit to replace the aforementioned controller and variable resistance circuit. The voltage controlling circuit is capable of adjusting the feedback voltage in response to the variation of the remnant voltage.

In contrast to the prior art, the DC to DC conversion circuit according to the present invention is capable of reporting the variation of the voltage actually needed by the load to the power management IC for controlling the DC to DC converter to generate the minimum voltage actually needed by the load. The DC to DC conversion circuit of the present invention is not only capable of decreasing the power consumption of the load, but also capable of increasing the durability of the load.

DETAILED DESCRIPTION OF THE PREFERRED EMBODIMENTS

Figure 1:
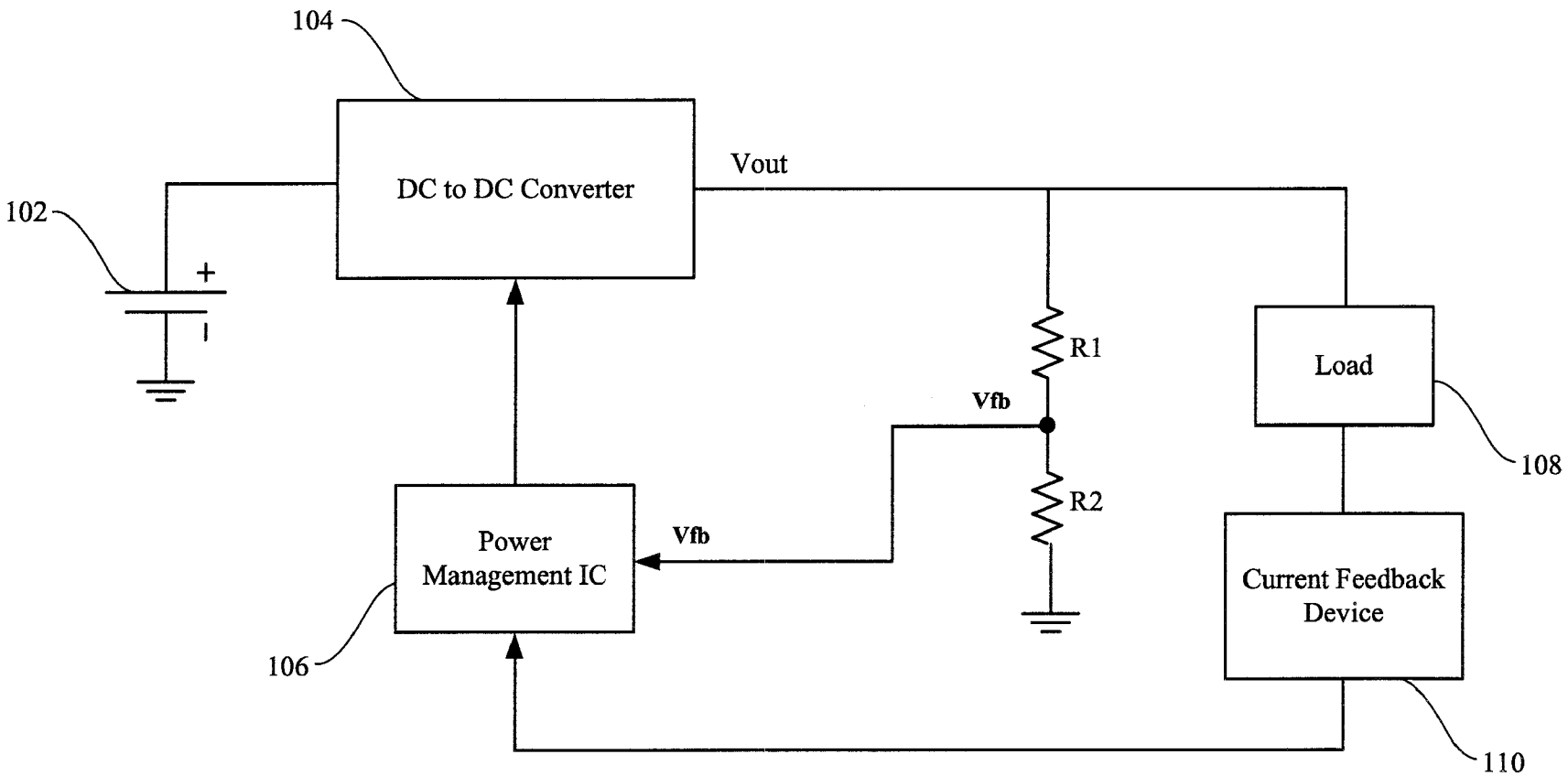
FIG. 1 (Prior Art)
FIG. 1 is a circuit diagram illustrating a conventional DC to DC conversion circuit.
Figure 2:
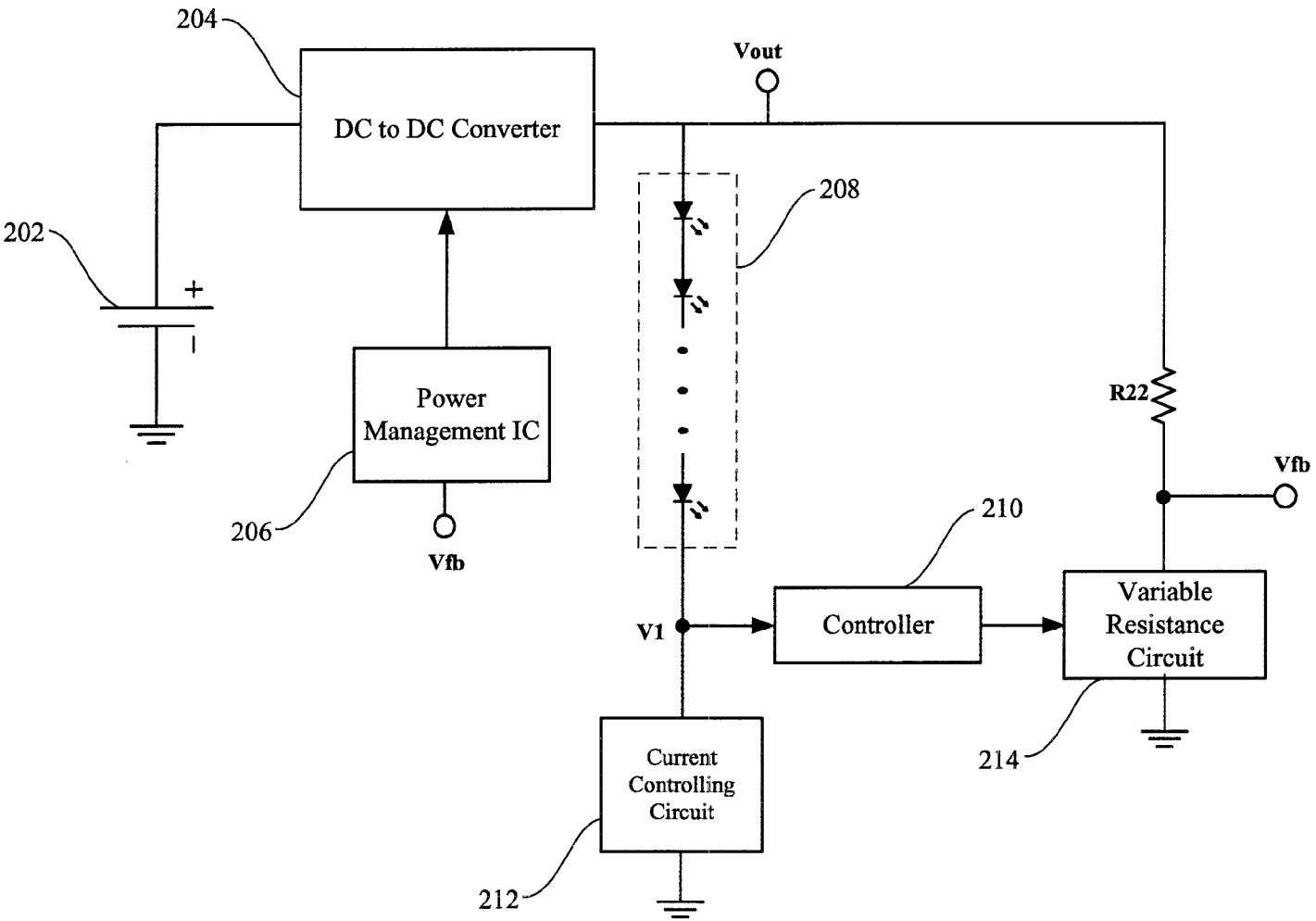
FIG. 2 is a circuit diagram illustrating a first embodiment of the DC to DC conversion circuit in accordance with the present invention.

Referring to FIG. 2, FIG. 2 is a circuit diagram illustrating a first embodiment of the DC to DC conversion circuit in accordance with the present invention. The first embodiment of the DC to DC conversion circuit comprises a DC power supply 202, a DC to DC converter 204, a power management IC 206, a load 208, a controller 210, a current controlling circuit 212 and a variable resistance circuit 214. The load 208 may be a backlight source in a LCD, and the backlight source may be consisted of a plurality of LEDs which are connected in series. The power management IC 206 may be a pulse-width modulation IC (PWM IC). In the first embodiment of the DC to DC conversion circuit, the power management IC 206 controls the DC to DC converter 204 for converting a voltage provided by the DC power supply 202 to an output voltage $V_{out}$ to supply to the load 208. The current controlling circuit 212 is used to stabilize the current flowed through the load 208. A remnant voltage V1 of the load 208 will be varied when the voltage needed by the load 208 changes. The controller 210 can adjust the equivalent resistance of the variable resistance circuit 214 in response to the variation of the remnant voltage V1. The variable resistance circuit 214 is connected with a resistor R22 in series. A feedback voltage $V_{fb}$ divided by the variable resistance circuit 214 and the resistor R22 will be changed in response to the variation of the equivalent resistance of the variable resistance circuit 214. Accordingly, the power management IC 206 can control the DC to DC converter 204 to adjust the output voltage $V_{out}$ thereof for matching the minimum voltage actually needed by the load 208.

The remnant voltage V1 will be increased when the voltage actually needed by the load 208 decreases, and then the feedback voltage $V_{fb}$ between the variable resistance circuit 214 and the resistor R22 will be increased accordingly. In the meantime, the power management IC 206 controls the DC to DC converter 204 to decrease the output voltage $V_{out}$ in response to the increasing feedback voltage $V_{fb}$ for matching the voltage needed by the load 208. Contrarily, the remnant voltage V1 will be decreased when the voltage needed by the load 208 increases, and then the feedback voltage $V_{fb}$ between the variable resistance circuit 214 and the resistor R22 will be decreased accordingly. In the meantime, the power management IC 206 controls the DC to DC converter 204 to increase the output voltage $V_{out}$ in response to the decreasing feedback voltage $V_{fb}$ for matching the voltage needed by the load 208. Therefore, the DC to DC conversion circuit according to the present invention can adjust the output voltage $V_{out}$ in response to the variation of the voltage needed by the load 208 for maintaining the output voltage $V_{out}$ to match the minimum voltage actually needed by the load.

Figure 3:
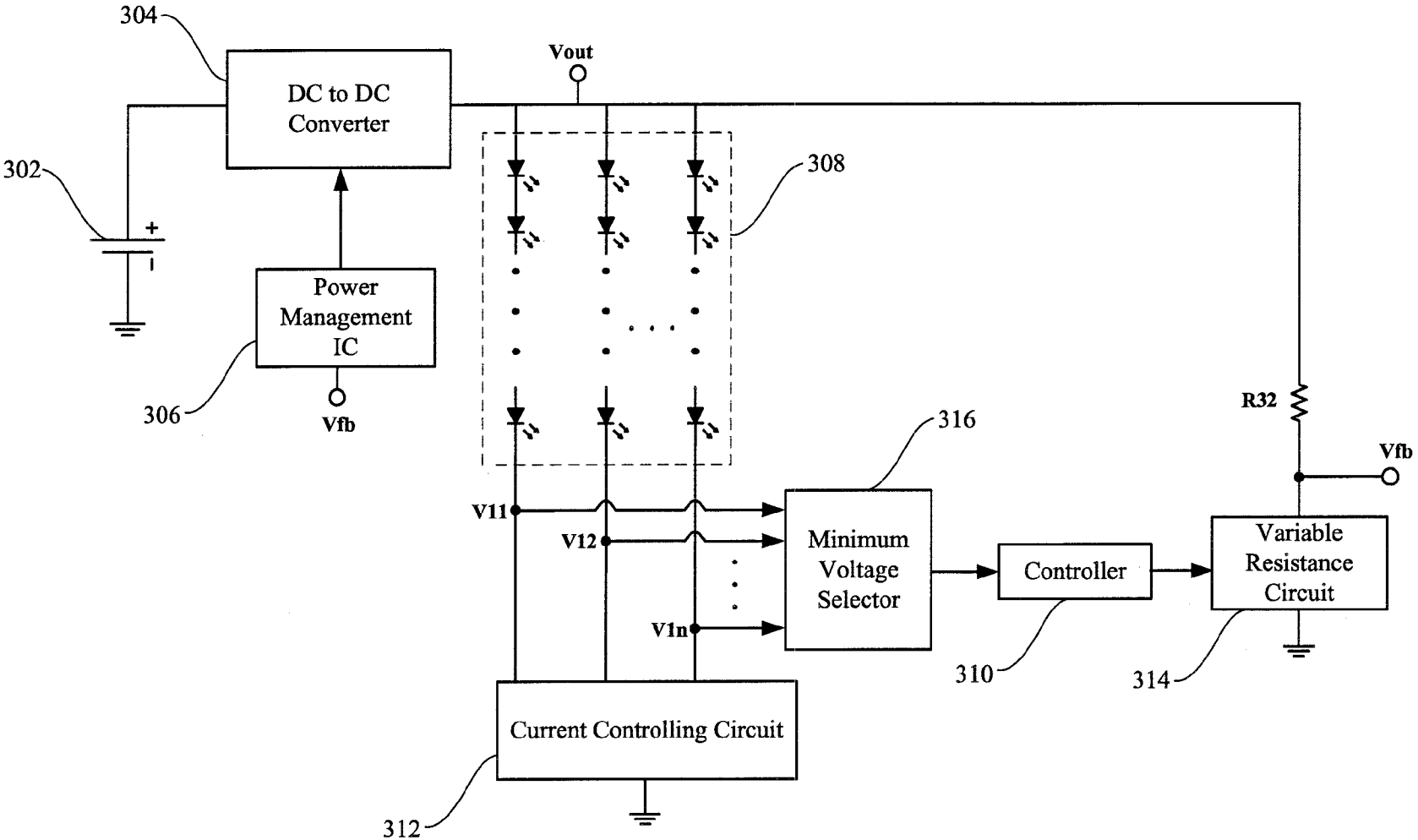
FIG. 3 is a circuit diagram illustrating a second embodiment of the DC to DC conversion circuit in accordance with the present invention.

Referring to FIG. 3, FIG. 3 is a circuit diagram illustrating a second embodiment of the DC to DC conversion circuit in accordance with the present invention. The second embodiment of the DC to DC conversion circuit comprises a DC power supply 302, a DC to DC converter 304, a power management IC 306, a load 308, a controller 310, a current controlling circuit 312, a variable resistance circuit 314, and a minimum voltage selector 316. The difference between the second and the first embodiments is that the load 208 of the first embodiment comprises a single string of LEDs, but the load 308 of the second embodiment comprises a matrix of LEDs. The matrix of LEDs includes several strings of LEDs, each string of LEDs is consisted of a plurality of LEDs connected in series. As a result, each string of LEDs of load 308 in the second embodiment needs a specific minimum voltage, and the output voltage $V_{out}$ must be higher than the highest voltage needed by the plurality of strings of LEDs. Therefore, the DC to DC converter 304 generates a minimum output voltage $V_{out}$ according to the highest voltage needed by the plurality of strings of LEDs. The remnant voltages V11, V12, . . . , V1*n* represent each remnant voltage of corresponding string of LEDs. The lowest remnant voltage indicates that the voltage needed by the corresponding string of LEDs is the highest. Accordingly, the minimum voltage selector 316 is used to select the lowest one from the remnant voltages V11, V12, . . . , V1*n* of the plurality of strings of LEDs. The lowest remnant voltage will be provided to the controller 310 for adjusting the equivalent resistance of the variable resistance circuit 314. Finally, the power management IC 306 controls the DC to DC converter 304 to generate the minimum output voltage $V_{out}$ actually needed by the load 308 in response to the variation of the feedback voltage $V_{fb}$.

Figure 4:
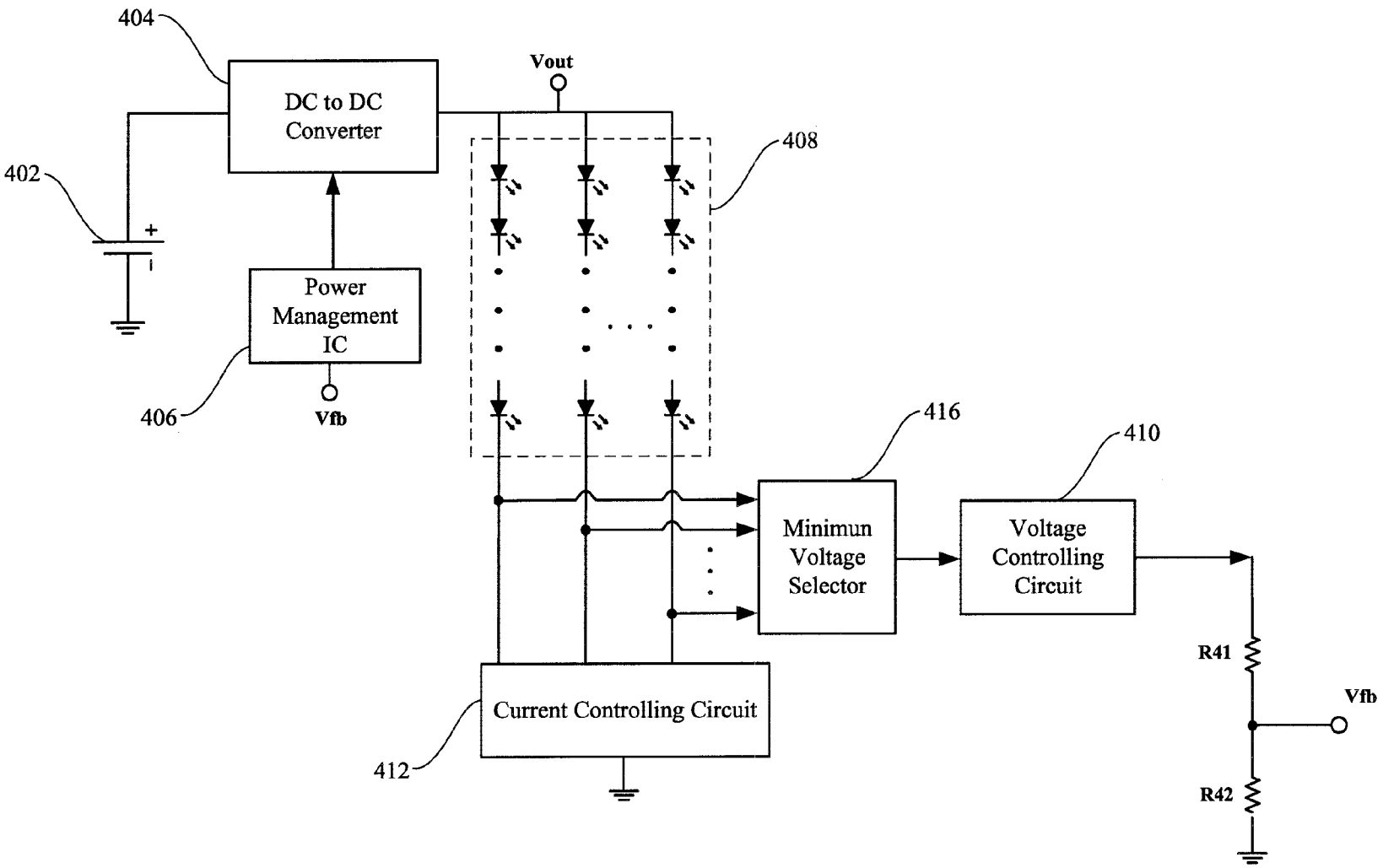
FIG. 4 is a circuit diagram illustrating a third embodiment of the DC to DC conversion circuit in accordance with the present invention.

Referring to FIG. 4, FIG. 4 is a circuit diagram illustrating a third embodiment of the DC to DC conversion circuit in accordance with the present invention. The third embodiment of the DC to DC conversion circuit comprises a DC power supply 402, a DC to DC converter 404, a power management IC 406, a load 408, a voltage controlling circuit 410, a current controlling circuit 412, and a minimum voltage selector 416. The difference between the third embodiment and the aforementioned embodiments is that the third embodiment uses the voltage controlling circuit 410 to adjust the feedback voltage $V_{fb}$ between the resistors R41, R42 in response to the lowest remnant voltage selected from the remnant voltages V11, V12, . . . , V1*n* by the minimum voltage selector 416. The lowest remnant voltage of remnant voltages V11, V12, . . . , V1*n* will be increased when the highest voltage needed by the strings of LEDs decreases, and then the voltage controlling circuit 410 increases the feedback voltage $V_{fb}$ in response to the increasing remnant voltage. In the meantime, the power management IC 406 controls the DC to DC converter 404 to decrease the output voltage $V_{out}$ in response to the increasing feedback voltage $V_{fb}$ for matching the voltage needed by the load 408. Contrarily, The lowest remnant voltage of remnant voltages V11, V12, . . . , V1*n* will be decreased when the highest voltage needed by the strings of LEDs increases, and then the voltage controlling circuit 410 decreases the feedback voltage $V_{fb}$ in response to the decreasing remnant voltage. In the meantime, the power management IC 406 controls the DC to DC converter 404 to increase the output voltage $V_{out}$ in response to the decreasing feedback voltage $V_{fb}$ for matching the voltage needed by the load 408.

Figure 5:
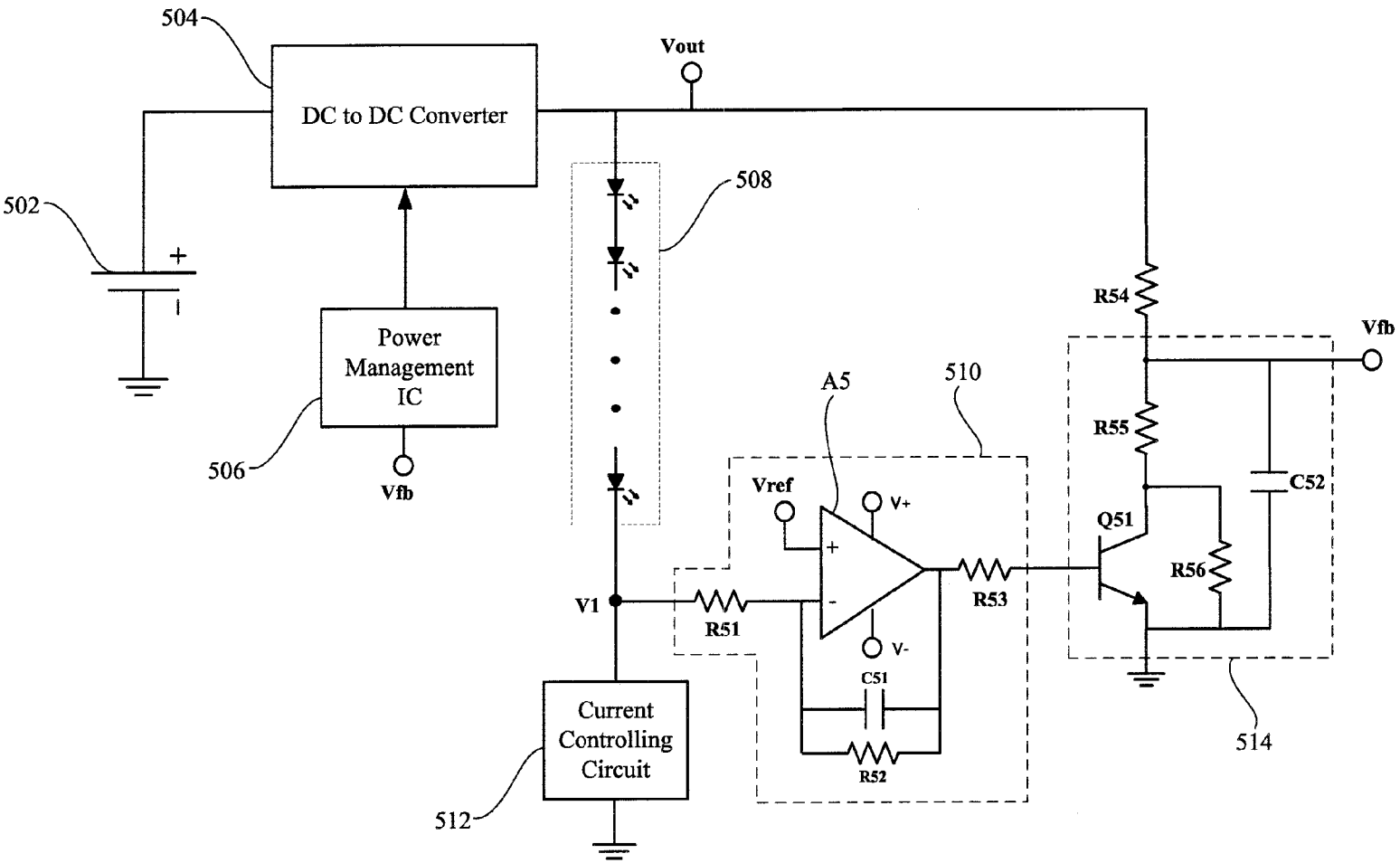
FIG. 5 is a detailed circuit diagram of the first embodiment of the DC to DC conversion circuit in accordance with the present invention.

Referring to FIG. 5, FIG. 5 is a detailed circuit diagram of the first embodiment of the DC to DC conversion circuit in accordance with the present invention. The power management IC 506 controls the DC to DC converter 504 to convert the voltage supplied by the DC power supply 502 to the output voltage $V_{out}$ for supplying to the load 508. The load 508 may be a single string of LEDs. The current controlling circuit 512 is used to stabilize the current flowed through the load 508. The remnant voltage V1 of the load 508 will be varied when the voltage needed by the load 508 changes. The controller 510 can adjust the equivalent resistance of the variable resistance circuit 514 in response to the variation of the remnant voltage V1. The controller 510 uses an inverting amplifier A5 to invert amplify the remnant voltage V1. The variable resistance circuit 514 uses a transistor Q51 to adjust the equivalent resistance thereof in response to the amplified remnant voltage V1. The transistor Q51 may be a bipolar junction transistor (BJT), a field-effect transistor (FET) or any other kind of transistor.

The amplifier A5 has a positive input voltage as a reference voltage $V_{ref}$ in the positive input end of the amplifier A5. The reference voltage $V_{ref}$ must be equal to the remnant voltage V1. A proportional integration (PI) controller (not shown) can be used to set the reference voltage $V_{ref}$ equal to the remnant voltage V1. The remnant voltage V1 is inputted into the negative input end of the amplifier A5 through a resistor R51. The remnant voltage V1 will be increased when the voltage actually needed by the load 508 decreases. The increasing remnant voltage V1 is inputted into the base of the transistor Q51 after amplified by the amplifier A5 according to the ratio of resistors R51 and R52 in the controller 510. The increasing remnant voltage will cause the equivalent resistance of the transistor Q51 to increase, that is, the equivalent resistance of variable resistance circuit 514 will be increased in the meanwhile. The feedback voltage $V_{fb}$ will be increased when the voltage drop between two ends of variable resistance circuit 514 increases due to the increasing equivalent resistance thereof. In the meantime, the power management IC 506 controls the DC to DC converter 504 to decrease the output voltage $V_{out}$ in response to the increasing feedback voltage $V_{fb}$. Therefore, the output voltage $V_{out}$ can be adjusted to match minimum voltage needed by the load 508. The first embodiment of the DC to DC conversion circuit further comprises a protection circuit for protecting the DC to DC conversion circuit. The protection circuit comprises two resistors R55 and R56. The resistor R55 is used to limit the maximum value of the output voltage $V_{out}$ when the transistor Q51 is completely short due to a circuit failure. The resistor R56 is used to prevent the feedback voltage $V_{fb}$ become floating (zero) when the transistor Q51 is completely cut-off due to a circuit failure.

Figure 6:
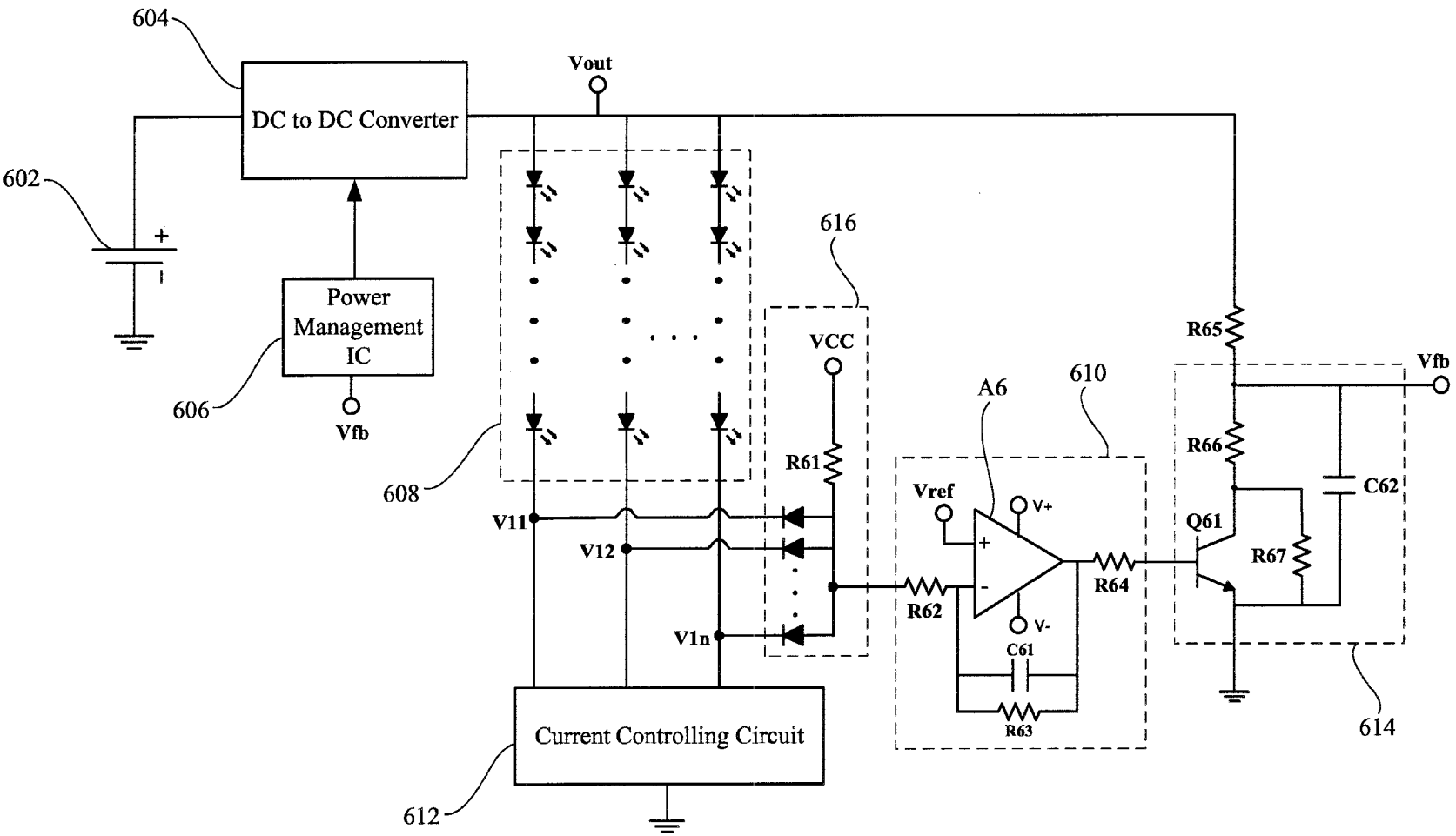
FIG. 6 is a detailed circuit diagram of the second embodiment of the DC to DC conversion circuit in accordance with the present invention.

Referring to FIG. 6, FIG. 6 is a detailed circuit diagram of the second embodiment of the DC to DC conversion circuit in accordance with the present invention. The load 608 of the second embodiment is a matrix of LEDs. The matrix of LEDs includes several strings of LEDs, each string of LEDs is consisted of a plurality of LEDs connected in series. A minimum voltage selector 616 is used to select the lowest remnant voltage in the plurality of strings of LEDs. Each string of LEDs has a tail end connected to a diode in order to couple the remnant voltage of each string of LEDs to an input end of controller 610 in a reverse bias form through the diode.

Figure 7:
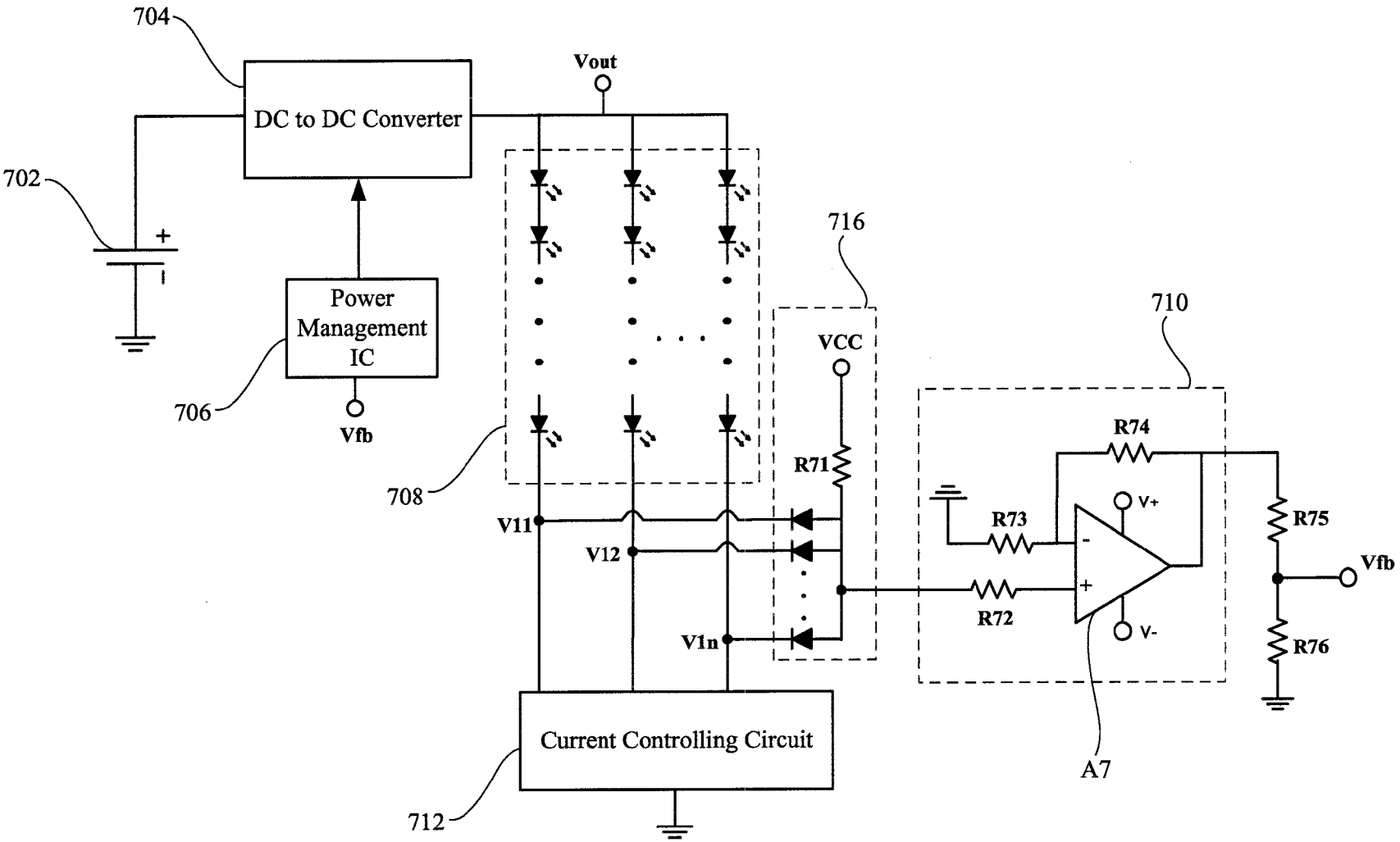
FIG. 7 is a detailed circuit diagram of the third embodiment of the DC to DC conversion circuit in accordance with me present invention.

Referring to FIG. 7, FIG. 7 is a detailed circuit diagram of the third embodiment of the DC to DC conversion circuit in accordance with the present invention. The third embodiment of the DC to DC conversion circuit uses a voltage controlling circuit 710 to adjust the feedback voltage $V_{fb}$ between the series resistors R75, R76 in response to the lowest remnant voltage selected by the minimum voltage selector 716. The feedback voltage $V_{fb}$ can be determined by the variation of the lowest remnant voltage in the plurality of LEDs strings. The voltage controlling circuit 710 includes an amplifier A7 to amplify the lowest remnant voltage of V1, V2, . . . , Vn. The lowest remnant voltage is inputted into a positive input end of the amplifier A7 through a resistor R72. The negative input end of the amplifier A7 is connected to ground through a resistor R73. The lowest remnant voltage is amplified by the amplifier A7 according to the ratio of resistors R73 and R74 for adjusting the feedback voltage $V_{fb}$ between the resistors R75, R76. The lowest remnant voltage of remnant voltages V11, V12, . . . , V1*n* will be increased when the highest voltage needed by the strings of LEDs decreases, and then the voltage controlling circuit 710 amplifies lowest remnant voltage for increasing the feedback voltage $V_{fb}$ between the resistors R75, R76. In the meantime, the power management IC 706 controls the DC to DC converter 704 to decrease the output voltage $V_{out}$ in response to the increasing feedback voltage $V_{fb}$ for matching the voltage needed by the load 708.

In contrast to the prior art, the DC to DC conversion circuit according to the present invention is capable of reporting the variation of the voltage actually needed by the load to the power management IC for controlling the DC to DC converter to generate the minimum voltage actually needed by the load. The DC to DC conversion circuit of the present invention is not only capable of decreasing the power consumption of the load, but also capable of increasing the durability of the load.

The mechanism of the embodiment in accordance with the present invention can be implemented in many ways of a circuit design, without departing from the spirit and scope of the present invention for any person skilled in the art.

What is claimed is:

1. A DC to DC conversion circuit comprising:

a load;

a DC to DC converter for converting a DC voltage supplied by a DC power supply to an output voltage supplied to the load;

a variable resistance circuit for outputting a feedback voltage in response to the equivalent resistance of the variable resistance circuit;

a controller for adjusting the equivalent resistance of the variable resistance circuit in response to a variation of a remnant voltage of the load so as to adjust the feedback voltage of the variable resistance circuit in response to the equivalent resistance of the variable resistance circuit; and a power management IC for controlling the DC to DC converter to supply the output voltage in response to the feedback voltage of the variable resistance circuit.

2. The DC to DC conversion circuit of claim 1, wherein the controller comprises an amplifier for amplifying the remnant voltage, the variable resistance circuit comprises a transistor for adjusting the equivalent resistance of the transistor in response to the amplified remnant voltage.

3. The DC to DC conversion circuit of claim 2, wherein the variable resistance circuit further comprises a protection circuit for preventing the DC to DC conversion circuit from failing.

4. The DC to DC conversion circuit of claim 3, wherein the protection circuit comprises at least a resistor connected with the transistor in parallel.

5. The DC to DC conversion circuit of claim 1, wherein the load is a single string of LEDs which comprises a plurality of LEDs connected in series.

6. The DC to DC conversion circuit of claim 1, wherein the load is a matrix of LEDs which comprises a plurality of strings of LEDs, each string of LEDs comprises a plurality of LEDs connected in series.

7. The DC to DC conversion circuit of claim 6, further comprising a minimum voltage selector for selecting a lowest remnant voltage in the plurality of strings of LEDs, then outputting the lowest remnant voltage to the controller.

8. The DC to DC conversion circuit of claim 7, wherein the minimum voltage selector comprises a plurality of diodes, each diode is connected to a tail end of corresponding string of LEDs, the remnant voltage of each string of LEDs is coupled to the controller in a reverse bias form through the diode.

9. The DC to DC conversion circuit of claim 1, wherein the power management IC is a pulse-width modulation IC.

10. The DC to DC conversion circuit of claim 1, further comprising a current circuit for stabilizing the current flowed through the load.

11. A DC to DC conversion circuit comprising:

a load;

a resistive device;

a DC to DC converter for converting a DC voltage supplied by a DC power supply to an output voltage supplied to the load;

a voltage controlling circuit for adjusting a feedback voltage of the resistive device in response to a remnant voltage of the load; and a power management IC for controlling the DC to DC converter to supply the output voltage in response to the feedback voltage of the resistive device.

12. The DC to DC conversion circuit of claim 11, wherein the resistive device comprises two resistors connected in series, the voltage controlling circuit adjusts a voltage drop of the series resistors in response to a variation of the remnant voltage of the load for generating the feedback voltage between the series resistors.

13. The DC to DC conversion circuit of claim 12, wherein the voltage controlling circuit comprises an amplifier for amplifying the remnant voltage, and outputting the amplified remnant voltage to the series resistors.

14. The DC to DC conversion circuit of claim 11, wherein the load is a single string of LEDs which comprises a plurality of LEDs connected in series.

15. The DC to DC conversion circuit of claim 11, wherein the load is a matrix of LEDs which comprises a plurality of strings of LEDs, each string of LEDs comprises a plurality of LEDs connected in series.

16. The DC to DC conversion circuit of claim 15, further comprising a minimum voltage selector for selecting a lowest remnant voltage in the plurality of strings of LEDs, then outputting the lowest remnant voltage to the controller.

17. The DC to DC conversion circuit of claim 16, wherein the minimum voltage selector comprises a plurality of diodes, each diode is connected to a tail end of corresponding string of LEDs, the remnant voltage of each string of LEDs is coupled to the controller in a reverse bias form through the diode.

18. The DC to DC conversion circuit of claim 11, wherein the power management IC is a pulse-width modulation IC.

19. The DC to DC conversion circuit of claim 11, further comprising a current circuit for stabilizing the current flowed through the load.

* * * * *